US005377393A

United States Patent [19]

Ellis

[11] Patent Number: 5,377,393

[45] Date of Patent: Jan. 3, 1995

[54] SEAT BELT BUCKLE

[75] Inventor: Robert P. Ellis, Romeo, Mich.

[73] Assignee: TRW Vehicle Safety Systems Inc., Lyndhurst, Ohio

[21] Appl. No.: 116,494

[22] Filed: Sep. 3, 1993

[51] Int. Cl.[6] ..... A44B 11/00

[52] U.S. Cl. ..... 24/637; 24/641

[58] Field of Search ..... 24/637, 641, 642, 643, 24/633, 639, 632

[56] References Cited

U.S. PATENT DOCUMENTS

| | | | |
|---|---|---|---|
| 3,131,451 | 5/1964 | Fisher | 24/637 |
| 3,465,393 | 9/1969 | Fisher | 24/637 |
| 4,535,514 | 8/1985 | Grabowski . | |
| 4,692,970 | 9/1987 | Anthony et al. . | |
| 4,797,984 | 1/1989 | Seto et al. | 24/641 |
| 4,942,649 | 7/1990 | Anthony et al. . | |
| 5,005,267 | 4/1991 | Sugimoto . | |
| 5,067,212 | 11/1991 | Ellis . | |

*Primary Examiner*—Victor N. Sakran
*Attorney, Agent, or Firm*—Tarolli, Sundheim & Covell

[57] ABSTRACT

A seat belt buckle (11) comprises a base (10) including a rear end portion (74) and a front end portion (75) located opposite the rear end portion. The base includes a first set of tabs (76, 77) at the rear end portion of the base and a second set of tabs (78, 79) at the front end portion of the base. A latch mechanism (12, 14, 16, 18, 20, 22) is supported on the base for engaging a seat belt locking tongue and locking it to the base. A one-piece buckle cover (26) includes wall portions (130, 131, 132, 133) defining a cavity (95) for receiving the base and the latch mechanism. The cover also includes a front portion and a rear portion located opposite the front portion. The cover further includes a first shoulder (136, 137) at the rear portion of the cover and a second shoulder (138) at the front portion of the cover. The first shoulder engages the first set of tabs when the base is received in the cavity in the cover. The second shoulder engages the second set of tabs when the base is received in the cavity in the cover. The first and second sets of tabs and the first and second shoulders cooperate together to retain the base and the cover against relative movement.

8 Claims, 6 Drawing Sheets

SEAT BELT BUCKLE

BACKGROUND OF THE INVENTION

1. Technical Field

The present invention relates to a seat belt buckle, and is particularly directed to a seat belt buckle comprising a buckle cover and a buckle base which are secured together.

2. Background Art

Seat belt buckles are known. During use, a seat belt buckle receives and locks a seat belt tongue in the buckle. Typically, a seat belt buckle includes a base on which a seat belt tongue latch mechanism is supported. A seat belt buckle also typically includes a cover having a cavity which receives the base and the seat belt tongue latch mechanism. It is important that the cover not become dislodged from the base during use.

SUMMARY OF THE INVENTION

In accordance with the present invention, a seat belt buckle receives and locks a seat belt tongue in the seat belt buckle. The seat belt buckle comprises a base and a latch mechanism supported on the base for engaging and locking the seat belt tongue to the base. The base includes a first end portion and a second end portion located opposite the first end portion. The base also includes a first set of tabs at the first end portion of the base and a second set of tabs at the second end portion of the base.

The seat belt buckle further comprises a buckle cover defining a cavity for receiving the base and the latch mechanism. The cover includes a front portion and a rear portion located opposite the front portion. The cover includes first shoulder means on the cover at the rear portion for engaging the first set of tabs when the base is received in the cavity in the cover. The cover also includes second shoulder means on the cover at the front portion for engaging the second set of tabs when the base is received in the cavity in the cover. The first and second sets of tabs and the first and second shoulder means cooperate together to retain the base and the cover against relative movement.

In one embodiment of the invention, a pair of slots are located at the rear portion of the cover adjacent the first shoulder means. The first set of tabs on the base includes a pair of bending tabs which are bendable from an unbent position to a bent position into the pair of slots. As the tabs are bent, they engage and deform the material forming the first shoulder means, and thereby retain the base and the cover against relative movement in one direction. The second shoulder means defines a pair of slots located at the front portion of the cover. The second set of tabs includes a pair of fingers which are inserted into the pair of slots of the second shoulder means to retain the base and the cover against relative movement in a direction opposite the one direction.

In another embodiment of the present invention, a seat belt buckle comprises a latch mechanism supported on a buckle base for engaging and locking a seat belt locking tongue to the base. The buckle base includes a retaining tab which is resiliently deflectable between a retracted position and an extended position. The seat belt buckle further comprises a buckle cover defining a cavity for receiving the base and the latch mechanism. The cover includes deflector surface means for (i) resiliently deflecting the retaining tab from the extended position to the retracted position as the base is inserted into the cavity in the cover, and (ii) allowing the retaining tab to move resiliently from the retracted position to the extended position to engage a part of the cover. Engagement of the retaining tab with the cover retains the base against movement relative to the cover and thereby blocks withdrawal of the base from the cavity in the cover when the base has been fully inserted into the cavity in the cover. The retaining tab has a cam surface which is engageable with the deflector surface means to deflect the retaining tab from the extended position to the retracted position. The retaining tab also has a blocking surface which is engageable with a part of the cover when the base has been fully inserted into the cavity in the cover and the retaining tab has moved from the retracted position to the extended position to block withdrawal of the base from the cavity in the cover.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

Figure 1:
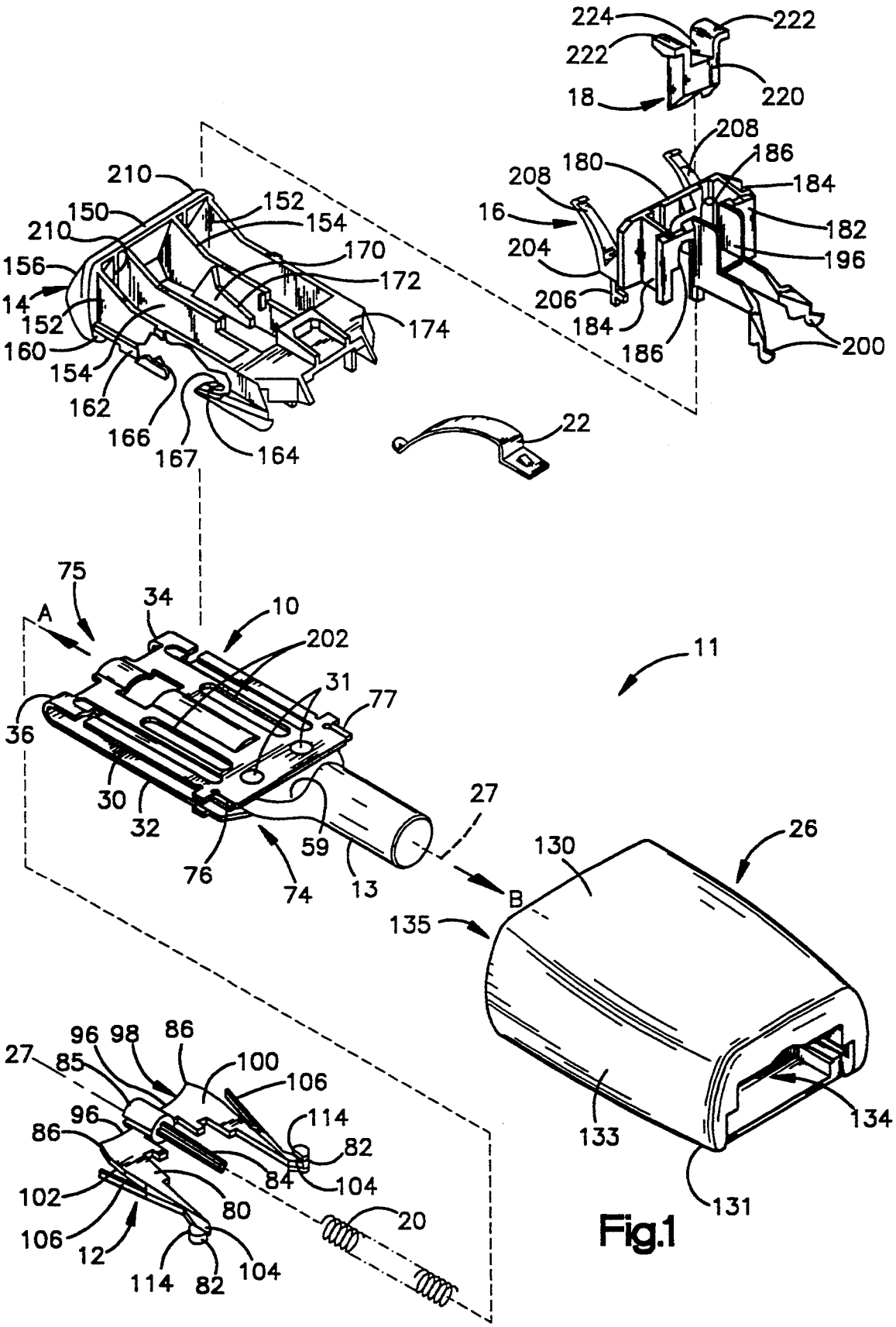
FIG. 1 is an exploded perspective view of a seat belt buckle constructed in accordance with the present invention.
Figure 2:
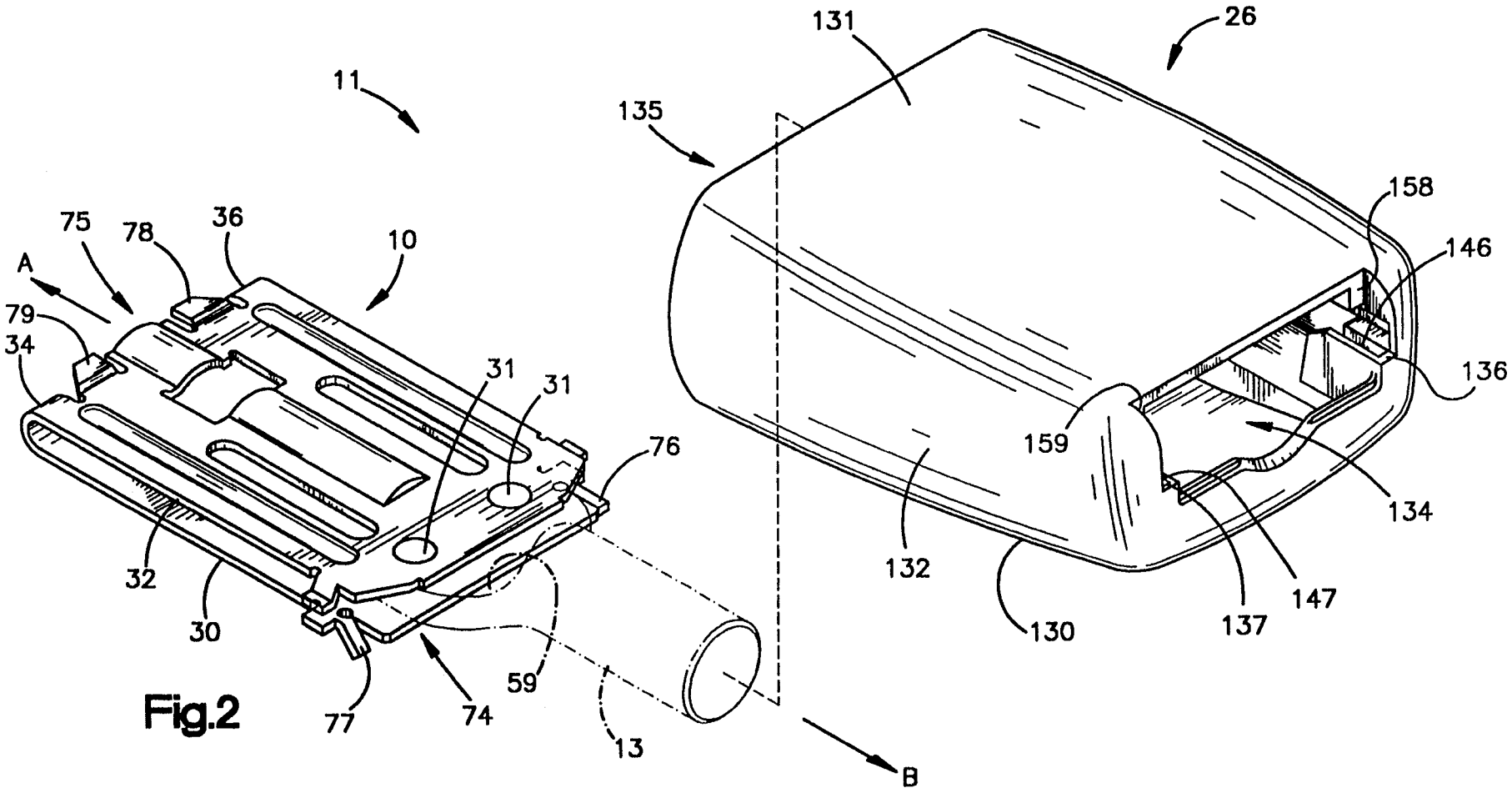
FIG. 2 is an enlarged exploded perspective view of certain components of the seat belt buckle of FIG. 1.

The present invention is directed to a seat belt buckle comprising a buckle cover and a buckle base which are secured together. The specific construction of the seat belt buckle may vary. As representative of the present invention, a seat belt buckle 11 embodying the present invention is illustrated in FIG. 1. It should be noted that FIG. 2 is an enlarged inverted view of some of the components shown in FIG. 1.

As shown in FIG. 1, the seat belt buckle 11 comprises a base 10, an ejector 12, and a pushbutton member 14. The seat belt buckle 11 further comprises a lock bar guide 16 and a lock bar 18, a coil spring 20, and a leaf spring 22. A one-piece buckle cover 26 contains components of the seat belt buckle 11 in positions centered on an axis 27 when the buckle 11 is assembled.

As shown in FIGS. 1–5, the base 10 is formed of an elongated metal piece which is folded to define an upper wall 30 and a lower wall 32. The upper wall 30 and the lower wall 32 are spaced apart from each other at a rear end portion 74 of the base 10. A flat end portion 59 of a stem 13 is located between the upper and lower walls 30, 32 at the rear end portion 74 of the base 10. The upper and lower walls 30, 32 and the flat end portion 59 of the stem 13 are fixedly connected together with a pair of rivets 31.

Figure 3:
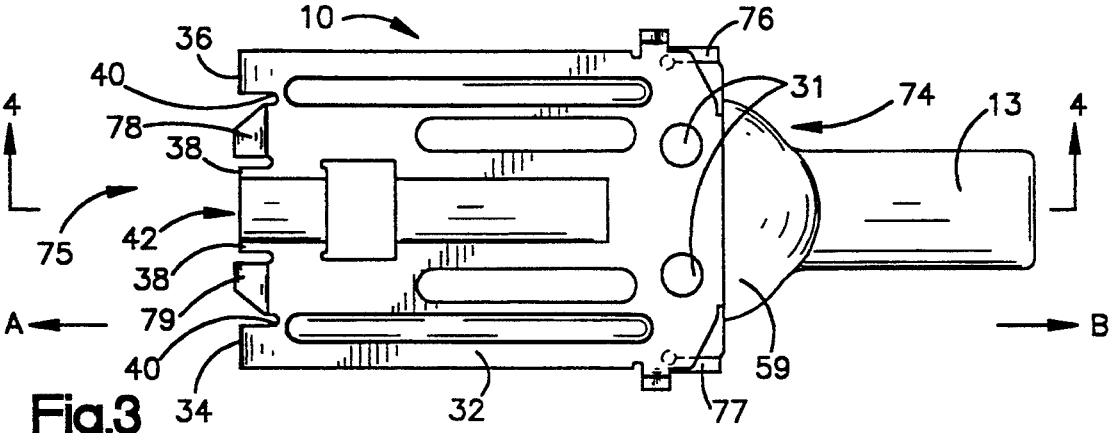
FIG. 3 is a plan view of a component of the seat belt buckle of FIG. 2.
Figure 4:
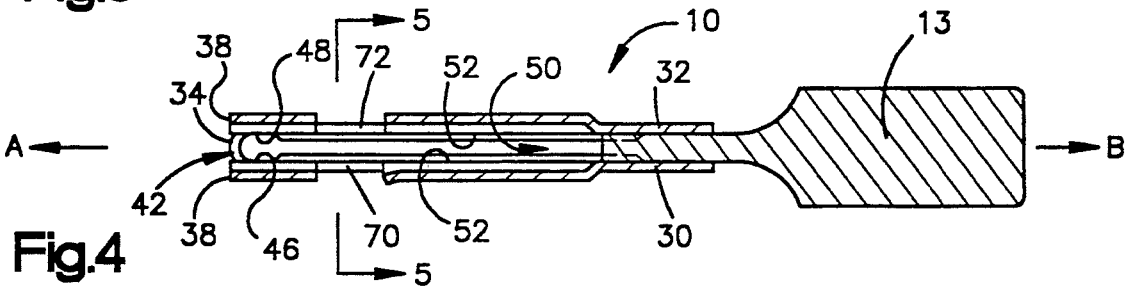
FIG. 4 is a sectional view taken approximately along line 4—4 of FIG. 3.
Figure 5:
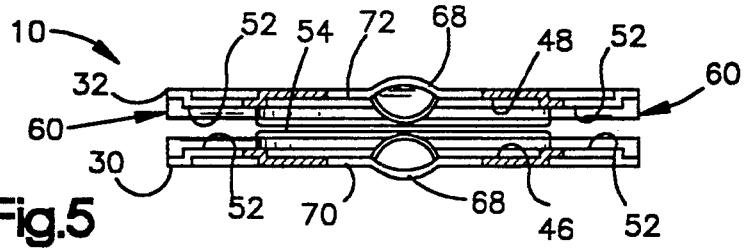
FIG. 5 is a sectional view taken approximately along line 5—5 of FIG. 4 showing some parts removed.
Figure 6:
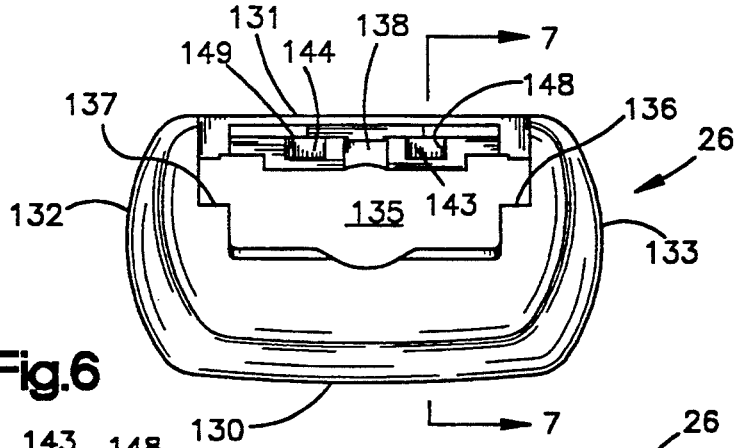
FIG. 6 is an end view of another component of the seat belt buckle of FIG. 2.
Figure 7:
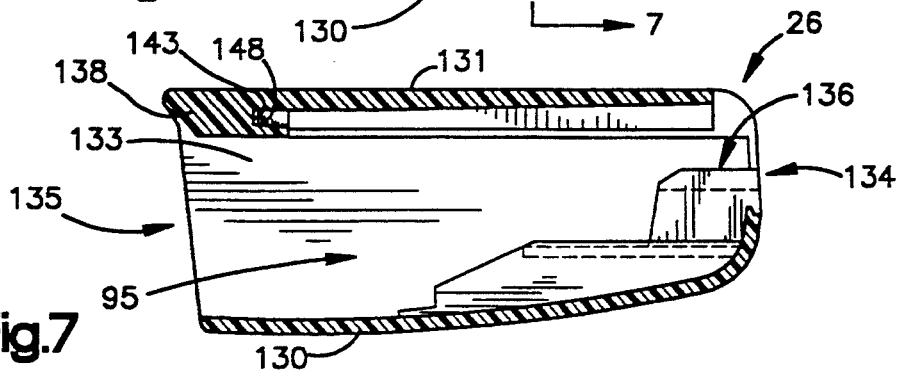
FIG. 7 is a sectional view taken approximately along line 7—7 of FIG. 6.
Figure 8:
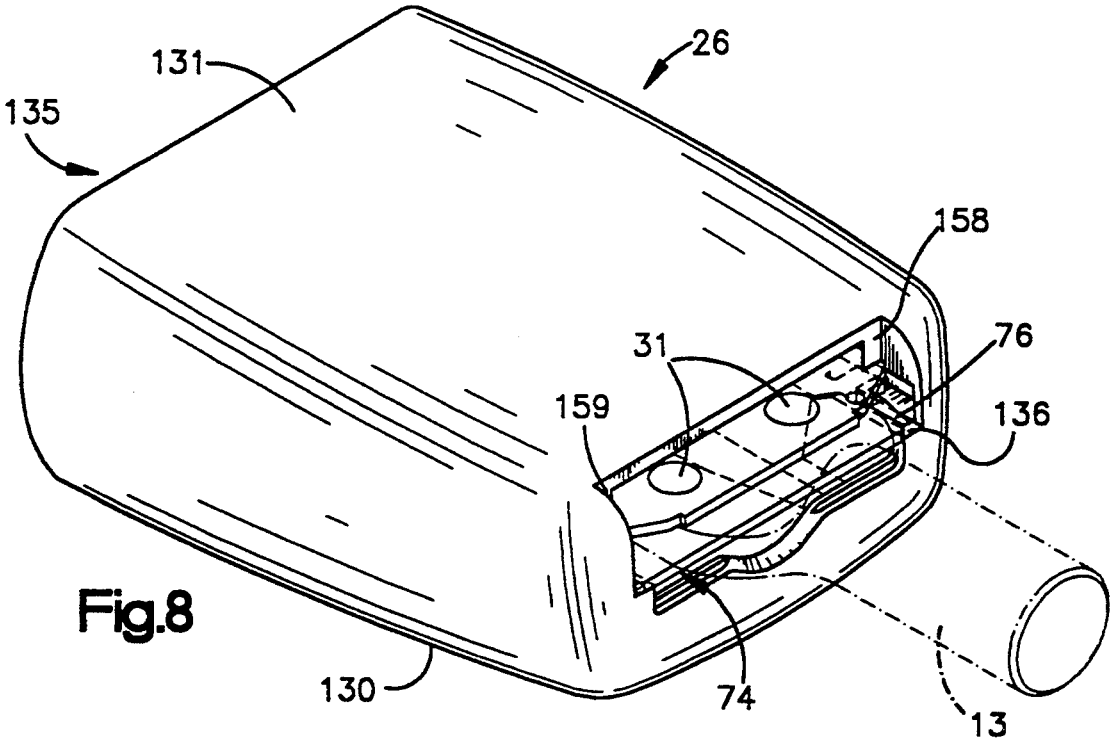
FIG. 8 is a perspective view similar to the perspective view of FIG. 2 but showing the components assembled together.

The base 10 also has a pair of spaced-apart, curved front end surfaces 34 and 36 that join the upper and lower walls 30 and 32 at a front end portion 75 of the base 10. The front end portion 75 of the base 10 is located opposite the rear end portion 74 of the base 10. Between the front end surfaces 34 and 36, each of the upper and lower walls 30 and 32 of the base 10 has a front edge surface 38 (FIGS. 3 and 4). Two spaced-apart notches 40 are defined adjacent to the curved front end surfaces 34 and 36. The front edge surfaces 38 and the curved front end surfaces 34 and 36 define a generally rectangular opening 42 at the front end portion 75 of the base 10. The opening 42 has a horizontal length approximately equal to the width of a seat belt locking tongue (not shown) and has a vertical width approximately equal to the thickness of the tongue.

The upper and lower walls 30 and 32 of the base 10 also have inner surfaces 46 and 48, respectively. The inner surfaces 46 and 48 are spaced apart to define a generally rectangular horizontal track 50 in the base 10 which extends inwardly from the opening 42. Each of the inner surfaces 46 and 48 includes a ridge portion 52 adjacent to each lateral side of the base 10. The ridge portions 52 of the inner surfaces 46 and 48 define a central region 54 (FIG. 5) of the track 50. The ridge portions 52 also define outer edge regions 60 of the track 50 on opposite lateral sides of the central region 54. Each of the upper and lower walls 30 and 32 of the base 10 further comprises a semi-cylindrical central portion 68. Cut-out surfaces 70 and 72 that extend through the central portions 68 define a passage extending vertically through the base 10.

As shown in FIG. 1, the ejector 12 comprises a body 80 and a pair of horizontally projecting tabs 82. The body 80 of the ejector 12 includes a shaft 84, a cylindrical forward end portion 85, and a pair of wing-like portions 86 projecting diametrically from the forward end portion 85. The wing-like portions 86 have forward edge surfaces 96 which define an ejector surface 98 extending transversely through the axis 27. Each of the wing-like portions 86 also has an upper horizontal planar surface 100 and a lower horizontal planar surface 102. The lower horizontal planar surface 102 is spaced vertically from the upper horizontal 10 planar surface 100 a distance which is approximately equal to the thickness of the seat belt locking tongue. Relatively narrow sections 104 of the body 80 support the tabs 82 at the rear end of the ejector 12. The narrow sections 104 include fingers 106 that project toward the forward end of the ejector 12, and are spaced from the wing-like portions 86. The tabs 82 have contact surfaces 114 which are spaced horizontally from the ejector surface 98 in a direction transverse to the axis 27.

The ejector 12 and the coil spring 20 are receivable in the opening 42 at the front end of the base 10. The coil spring 20 is received coaxially over the shaft 84 on the ejector 12, and fits between the semi-cylindrical portions 68 of the upper and lower walls 30 and 32 of the base 10. One axial end of the coil spring 20 rests against the forward end portion 85 of the ejector 12. The other axial end of the coil spring 20 rests against stop surfaces (not shown) on an end of the stem 13. The fingers 106 on the ejector 12 are resiliently flexible in directions transverse to the axis 27 in order to permit passage of the ejector 12 inwardly through the opening 42, and to block passage of the ejector 12 outwardly through the opening 42.

When the seat belt buckle 11 is assembled together, the ejector 12 is received in the track 50 with the tabs 82 in the outer edge regions 60 of the track 50. The narrow sections 104 of the ejector 12 are received in the track 50 between the ridge portions 52 of the inner surfaces 46 and 48. The wing-like portions 86, the forward end portion 85, and the shaft 84 are received in the central region 54 of the track 50. The upper surface 100 on the ejector 12 slides against the inner surface 46 of the upper wall 30 of the base 12. The lower surface 102 slides against the inner surface 48 of the lower wall 38 of the base 12. The ejector 12 is thus guided for axial sliding movement in the track 50.

The pushbutton member 14 comprises a front wall 150, two outer walls 152, and two inner walls 154. The outer and inner walls 152 and 154 are perpendicular to and extend axially away from the front wall 150. Vertical ribs 210 are disposed at the front wall 150 of the pushbutton member 14. The front wall 150 has an upper surface 156 and a lower surface 160. The lower surface 160 defines an opening (not shown) for horizontal movement of the seat belt locking tongue beneath the upper surface 156. Each of the outer walls 152 of the pushbutton member 14 supports an outwardly extending ledge 162 which engages the cover 26. Each of the outer walls 152 also supports an inwardly extending tab 164 and an inwardly extending guide piece 166. The tabs 164 have vertically extending contact surfaces 167. Each of the inner walls 154 of the pushbutton member 114 has a cam structure 170 with an inclined surface 172. A rear bridging portion 174 of the pushbutton member 14 rigidly connects the outer walls 152 and the inner walls 154. The rear bridging portion 174 supports the leaf spring 22 when the seat belt buckle 11 is assembled together.

The pushbutton member 14 has an assembled position in which the tabs 164 and the guide pieces 166 extend into the outer edge regions 60 of the track 50. The pushbutton member 14 is thus supported on the base 10 for axial sliding movement relative to the base 10.

The lock bar guide 16 has a front wall 180, a rear wall 182, and a pair of opposite side walls 184. The front and rear walls 180 and 182 of the lock bar guide 16 have surfaces 186 which define arch-shaped openings through the front and rear walls 180 and 182. A surface 196 defines an upwardly open three-sided rectangular passage extending centrally through the rear wall 182. Mounting legs 200 extend rearwardly from the rear wall 182, and have shapes adapted to snap into engagement with corresponding mounting surfaces 202 (FIG. 1) in the upper wall 30 of the base 10. A pair of triangular walls 204 project forwardly from the front wall 180. Each triangular wall 204 supports a downwardly projecting mounting tab 206 and an upwardly projecting resiliently flexible spring member 208.

The lock bar guide 16 has a stationary assembled position mounted on the base 10. When in its assembled position, the lock bar guide 16 has the mounting legs 200 engaged with the mounting surfaces 202 at the top of the base 10, and has the mounting tabs 206 engaged in the notches 40 at the front of the base 10.

When the lock bar guide 16 and the pushbutton member 14 are both in their assembled positions, the inner walls 154 of the pushbutton member 14 extend axially through the arch-shaped openings defined by the surfaces 186 on the lock bar guide 16. The leaf spring 22 extends through the passage defined by the surface 196 on the lock bar guide 16. Also, the vertical ribs 210 at the front wall 150 of the pushbutton member 14 engage the upper ends of the spring members 208. The pushbutton member 14 is thus slidable axially relative to both the lock bar guide 16 and the base 10 when in its assembled position. The spring members 208 on the lock bar guide 16 exert a biasing force urging the pushbutton member 14 axially forward.

The lock bar 18 has a body portion 220, a pair of flanges 222, and a surface 224 defining an upwardly open recess. The lock bar 18 is receivable in a passage which is defined between the front and rear walls 180 and 182 of the lock bar guide, and between the inner walls 154 of the pushbutton member 14. The lock bar 18 is movable vertically between an upward position and a downward position in which it projects through the passage defined by the cut-out surfaces 70 and 72 in the base 10. The leaf spring 22 exerts a biasing force against the surface 224 of the lock bar 18 to urge the lock bar 18 vertically downward. A stop surface (not shown) on the lock bar guide 16 limits upward vertical movement of the lock bar 18.

The seat belt buckle 11 has an open condition in which the ejector 12 is held by the coil spring 20 in a position adjacent to the front end of the track 50 in the base 10. The ejector 12 then blocks vertical movement of the lock bar 18 through the passage defined by the cut-out surfaces 70 and 72 in the base 10. The seat belt locking tongue is movable into the central region 54 of the track 50 through the opening 42 so that the leading surface on the tongue engages the ejector surface 98 on the ejector 12. The seat belt locking tongue can be guided into the opening 42 by suitable tongue guide surfaces (not shown). The seat belt locking tongue is further movable along the track 50 with upper and lower surfaces on the tongue being guided in sliding contact with the inner surfaces 46 and 48 on the base 10. The seat belt locking tongue thus moves the ejector 12 against the bias of the coil spring 20. When the ejector 12 no longer blocks vertical movement of the lock bar 18 through the passage defined by the cut-out surfaces 70 and 72 in the base 10, the lock bar 18 is moved under the influence of the leaf spring 22. The lock bar 18 then extends through the track 50 and through an aperture in the seat belt locking tongue to lock the tongue in the seat belt buckle 11.

When the seat belt locking tongue is to be released from the seat belt buckle 11, the vehicle occupant manually exerts pressure against the upper surface 156 on the front wall 150 of the pushbutton member 14 to slide the pushbutton member 14 rearwardly relative to the base 10. When the pushbutton member 14 slides rearwardly, the inclined surfaces 172 on the cam structures 170, which are supported on the inner walls 154 of the pushbutton member 14, move against the flanges 222 on the lock bar 18 to lift the lock bar 18 vertically upward. The lock bar 18 is thereby moved into its upward position in which it does not extend through the aperture in the seat belt locking tongue. The ejector 12 is then free to move the seat belt locking tongue axially forward in the track 50 under the influence of the coil spring 20 to eject the tongue from the seat belt buckle 11.

The ejector 12, the pushbutton member 14, the lock bar guide 16, the lock bar 18, the coil spring 20, and the leaf spring 22 together comprise a latch mechanism which is supported on the base 10. Each of the components, including the ejector 12, the pushbutton member 14, the lock bar guide 16, the lock bar 18, the coil spring 20, and the leaf spring 22, is known.

In accordance with the present invention, the base 10 includes a pair of bending tabs 76, 77 (as best shown in FIG. 2) at the rear end portion 74 of the base 10 and a pair of fingers 78, 79 at the front end portion 75 of the base 10. Each of the bending tabs 76, 77 is bendable from an unbent position to a bent position. For purposes of illustration only in FIG. 2, the bending tab 76 is shown in an unbent position and the bending tab 77 is shown in a bent position. The pair of fingers 78, 79 project away from the front end portion 75 of the base 10 in a given direction (shown as arrow A in FIGS. 1 and 2). The pair of bending tabs 76, 77 project away from the rear end portion 74 of the base 10 in a direction (shown as arrow B in FIGS. 1 and 2) which is opposite the direction of arrow A when the pair of bending tabs 76, 77 are in their unbent positions. Each of the bending tabs 76, 77 projects away from the rear end portion 74 of the base 10 in another direction (see tab 77 in FIG. 2) which is transverse to the direction of arrow A when the bending tab is in its bent position.

Referring to FIGS. 1, 2, 6 and 7, the one-piece buckle cover 26 comprises a first main wall portion 130, a second main wall portion 131, and a pair of side wall portions 132, 133 interconnecting the main wall portions 130, 131. As already mentioned, FIG. 2 is an enlarged inverted view of some of the components shown in FIG. 1. The four wall portions 130, 131, 132, 133 define a rear opening 134 and a front opening 135 located opposite the rear opening 134. The four wall portions 130, 131, 132, 133 also define a cavity 95 which extends between the rear opening 134 and the front opening 135.

A front shoulder 138 is located centrally on the main wall portion 131 adjacent the front opening 135. The front shoulder 138 has a pair of slots 148, 149 which receive the pair of fingers 78, 79 when the base 10 is received in the cavity 95. A pair of rear shoulders 136, 137 are located on the main wall portion 130 adjacent the rear opening 1.34. The rear shoulder 136 is adjacent the side wall portion 133 and the rear shoulder 137 is adjacent the side wall portion 132.

The structure of the rear shoulder 136 is symmetrically identical with the structure of the rear shoulder 137. The rear shoulder 136 has a slot 146 (FIG. 2) which receives the bending tab 76 in a bent position when the base 10 is received in the cavity 95. A rearward-facing abutment surface 158 is located in the vicinity of the rear opening 134 and above the slot 146, as best shown in FIG. 2. Similarly, the rear shoulder 137 has a slot 147 which receives the bending tab 77 in a bent position when the base 10 is received in the cavity 95. A rearward-facing abutment surface 159 is located in the vicinity of the rear opening 134 and above the slot 147, as shown in FIG. 2.

The base 10 and the cover 26 are assembled together as described below. First, all of the other components of the buckle 11, including the ejector 12, the pushbutton member 14, the lock bar guide 16, the lock bar 18, the coil spring 20, and the leaf spring 22, are assembled on the base 10. The stem 13 of the base 10 is placed through the front opening 135 of the cover 26 into the cavity 95. The stem portion 13 is then placed through the rear opening 134 and pulled through until the base 10 and the latching mechanism supported on the base 10 are fully received in the cavity 95. After the base 10 and the latch mechanism are fully received in the cavity 95, sufficient clearance is provided between the pair of fingers 78, 79 and the front shoulder 138 to allow the fingers 78, 79 to be slidably inserted into the slots 148, 149 in the front shoulder 138. The fingers 78, 79 are slidably inserted into the slots 148, 149 by slightly moving the front end portion 75 of the base 10 towards the front opening 135. The fingers 78, 79 engage end surfaces 143, 144 which define in part the slots 148, 149 in the front shoulder 138.

Figure 9:
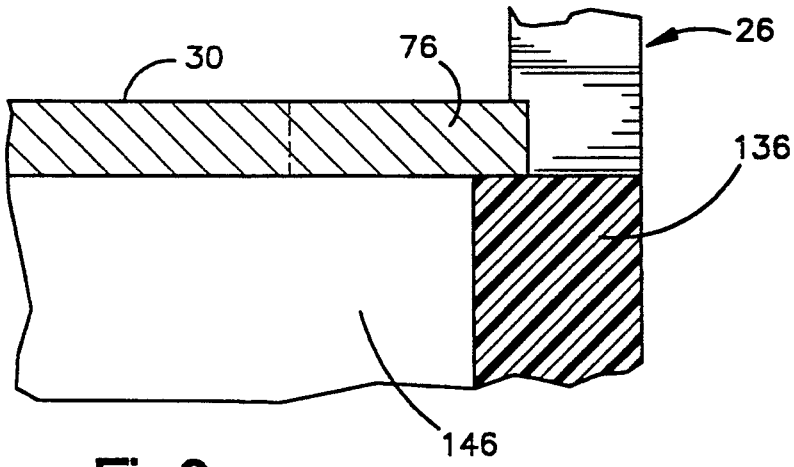
FIG. 9 is an enlarged cross-sectional view of a bendable tab associated with the component of FIG. 3 and shown in an unbent position.

After the fingers 78, 79 are fully inserted into the slots 148, 149, the bending tabs 76, 77 are positioned relative to the slots 146, 147 in the rear shoulder 136 such that the bending tabs 76, 77 can be bent into the slots 146, 147. The bending tab 76 extends approximately one millimeter over the rear shoulder 136 when the bending tab 76 is in its unbent position during assembly, as shown in FIG. 9. The bending tab 77 extends also approximately one millimeter over the rear shoulder 137 when the bending tab is in its unbent position during assembly. The bending tabs 76, 77 are bent into the slots 146, 147 using a suitable tool, such as an arbor press. Preferably, the bending tabs 76, 77 are bent approximately 25° from their original unbent positions.

Figure 10:
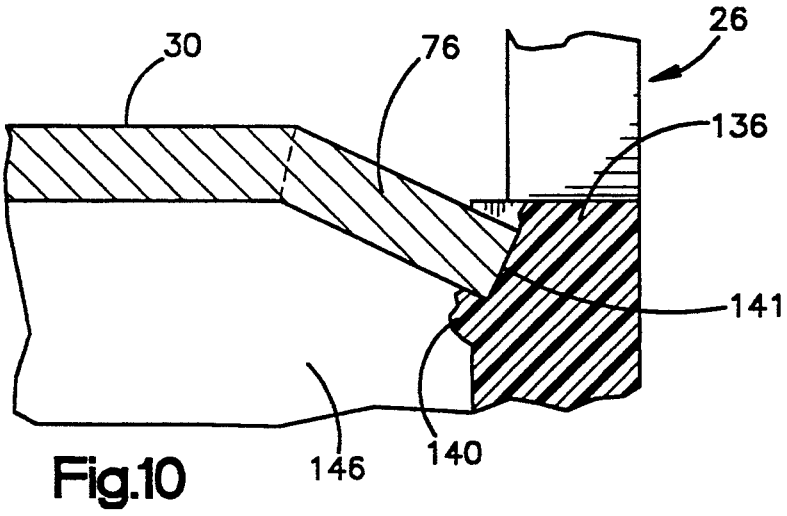
FIG. 10 is a view similar to the cross-sectional view of FIG. 9 but showing the bendable tab in a bent position.
Figure 11:
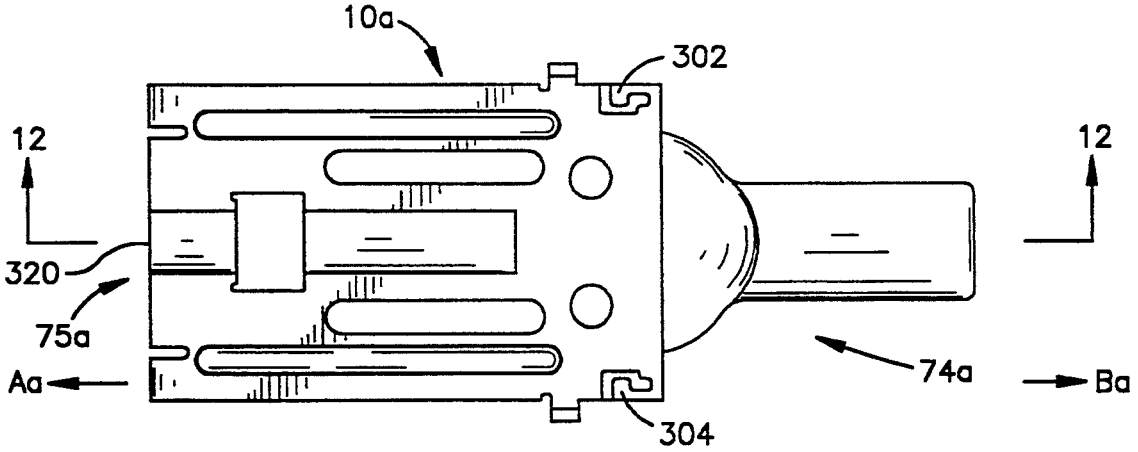
FIG. 11 is a plan view similar to FIG. 3 but showing a component of a second embodiment of the present invention.
Figure 12:
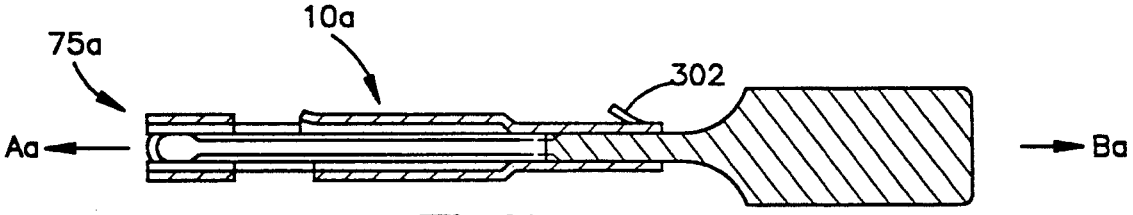
FIG. 12 is a sectional view taken approximately along line 12—12 of FIG. 11.

When the bending tab 76 is bent from its original unbent position shown in FIG. 9 to its bent position shown in FIG. 10, a portion 140 of the rear shoulder 136 is deformed, as shown in FIG. 10, because of the bending tab 76 extending approximately one millimeter over the rear shoulder 136 when it is in its original unbent position as shown in FIG. 9. A roughened surface 141 is formed on the rear shoulder 136 as a result of the rear shoulder 136 being deformed. The deformed portion 140 and the roughened surface 141 cooperate to prevent longitudinal sliding movement of the tab 76 and thereby to prevent longitudinal sliding movement of the base 10 relative to the cover 26. The walls defining the slot 146 prevent lateral sliding movement of the tab 76 and thereby prevent lateral sliding movement of the base 10 relative to the cover 26. In the same way, the bending tab 77 prevents longitudinal sliding movement of the base 10 relative to the cover 26 and lateral sliding movement of the base 10 relative to the cover 26. Thus, by inserting the fingers 78, 79 into the slots 148, 149 and then bending the bending tabs 76, 77 into the slots 146, 147 in the manner as just described, the base 10 and the cover 26 are retained together against relative movement in opposite longitudinal directions as shown by arrows A and B in FIGS. 1–4.

Another embodiment of the present invention is illustrated in FIGS. 11–16. Since the embodiment of the invention illustrated in FIGS. 11–16 is generally similar to the embodiment of the invention illustrated in FIGS. 1–10, similar numerals are utilized to designate similar components, the suffix letter "a" being associated with the embodiment of FIGS. 11–16 to avoid confusion.

Figure 15:
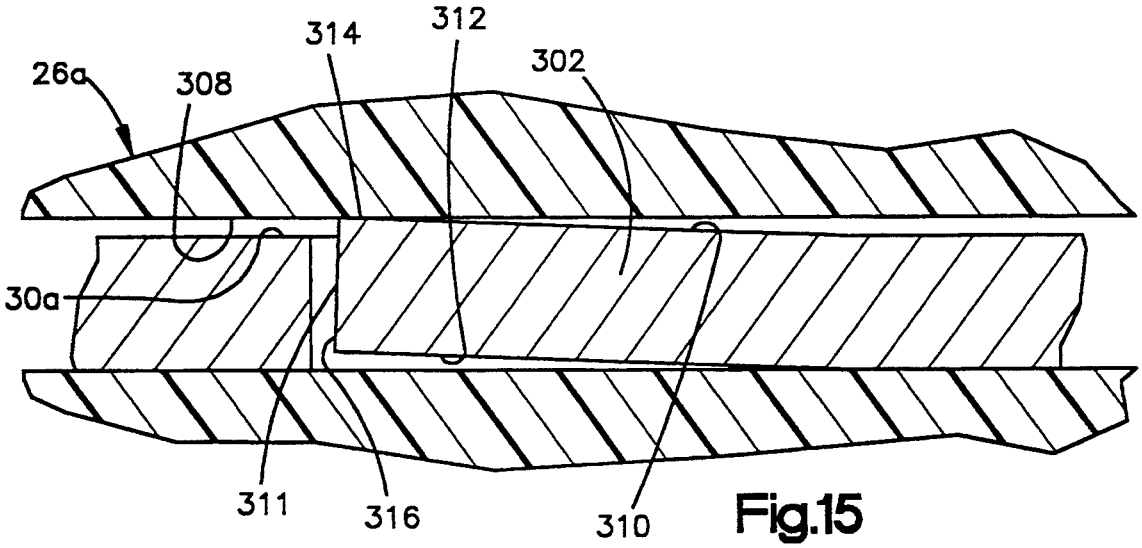
FIG. 15 is an enlarged view of parts of the components of FIGS. 11 and 13 in a partially assembled condition.
Figure 16:
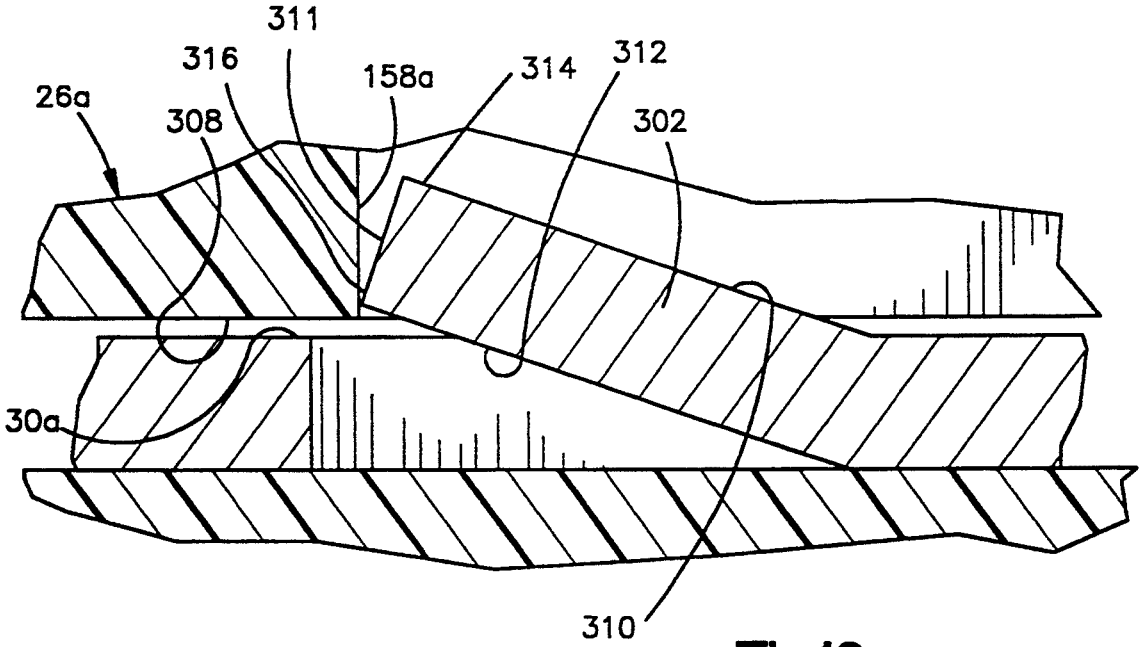
FIG. 16 is a view similar to FIG. 15 but showing the parts of the components of FIGS. 11 and 13 in a fully assembled condition.

The tongue latch mechanism (not shown) is supported on the base **10*a* and engages and locks a seat belt locking tongue (not shown) to the base 10*a*. A front end blocking surface 320 is located at the front end portion 75*a* of the base 10*a*. The base 10*a* includes a pair of retaining tabs 302, 304 (FIG. 11) which are resiliently deflectable between a retracted position and an extended position. More specifically, as shown in enlarged detail in FIGS. 15 and 16, the retaining tab 302 is resiliently deflectable between a retracted position (FIG. 15) and an extended position (FIG. 16). The retaining tab 304 is resiliently deflectable between a retracted position and an extended position in the same manner as the retaining tab 302. The retaining tabs 302, 304 are located at the rear end portion 74*a* of the base 10*a* and project towards the front end portion 75*a* of the base 10*a* generally in the direction of arrow Aa when the retaining tabs 302, 304** are in their extended positions.

The structure and operation of the retaining tab 302 are the same as the structure and operation of the retaining tab 304. For simplicity, only the structure and operation of the retaining tab 302 will be described in detail. As shown in FIGS. 15 and 16, the retaining tab 302 has opposite major surfaces 310, 312 and an end surface 311 extending transverse to the opposite major surfaces 310, 312. A cam surface area 314 is defined between the major surface 310 and the end surface 311. A blocking surface area 316 is defined between the major surface 312 and the end surface 311.

Figure 13:
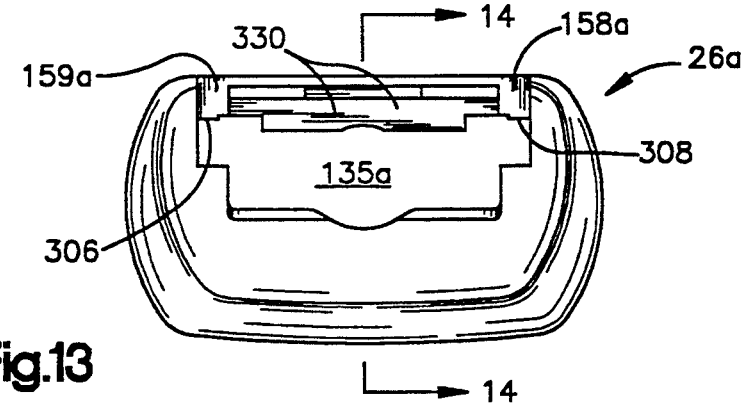
FIG. 13 is an end view of another component of the second embodiment of FIG. 11.

The cover **26*a* includes a generally flat front end surface 330 (FIGS. 13 and 14) located in the vicinity of the front opening 135*a*. The cover 26*a* further includes deflector surfaces for resiliently deflecting the retaining tabs 302, 304 from their extended positions to their retracted positions as the base 10*a* is initially inserted into the cavity 95*a* in the cover 26*a*. As shown in FIG. 13 and in enlarged detail in FIG. 15, the cover 26*a* has a deflector surface 308 for engaging the cam surface area 314 of the retaining tab 302 and thereby to resiliently deflect the retaining tab 302 from its extended position to its retracted position as the base 10*a* is initially inserted into the cavity 95*a* in the cover 26*a*. Similarly, as shown in FIG. 13 only, the cover 26*a* has a deflector surface 306 for engaging a cam surface area (not shown) of the retaining tab 304 and thereby to resiliently deflect the retaining tab 304 from its extended position to its retracted position as the base 10*a* is initially inserted into the cavity 95*a* in the cover 26*a***.

Figure 14:
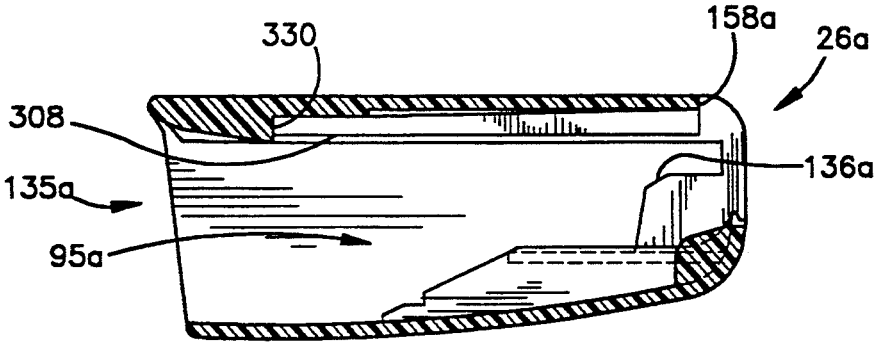
FIG. 14 is a sectional view taken approximately along line 14—14 of FIG. 13.

After the base **10*a* is fully inserted into the cavity 95*a*, the retaining tabs 302, 304 resiliently move back from their retracted positions to their extended positions to engage with the cover 26*a* to retain the base 10*a* against movement relative to the cover 26*a*. As shown in FIG. 14 and in enlarged detail in FIG. 16, the blocking surface area 316 of the retaining tab 302 engages the abutment surface 158***a* on the base 10*a*. The abutment surface 158*a* extends transverse to the deflector surface 308 on the base 10*a*. Similarly, a blocking surface area (not shown) of the retaining tab 304 engages the abutment surface 159*a* (FIG. 13) which extends transverse to the deflector surface 306 on the base 10*a*. When the blocking surface area 316 of the retaining tab 302 engages the abutment surface 158*a* and the blocking surface area of the retaining tab 304 engages the abutment surface 159*a*, the base 10*a* is blocked from being withdrawn from the cavity 95*a* in the cover 26*a*. The front end portion 75*a* of the base 10*a* is then moved slightly towards the front opening 135*a* until the front end blocking surface 320 on the base 10*a* engages the front end surface 330 on the cover 26*a*. When this occurs, the base 10*a* is also blocked from being withdrawn from the cavity 95*a* in the cover 26*a*. Thus, the base 10*a* is blocked from being withdrawn from the cavity 95*a* in the cover 26*a* after the base 10*a* has been fully inserted into the cavity in the cover 26*a*.

From the above description of the invention, those skilled in the art of the present invention will perceive improvements, changes and modifications. Such improvements, changes and modifications within the skill of the art of the present invention are intended to be covered by the appended claims.

Having described the invention, the following is claimed:

1. A seat belt buckle for receiving and locking a seat belt tongue, said buckle comprising:

a base including a first end portion and a second end portion located opposite said first end portion;

a latch mechanism supported on said base for engaging and locking the seat belt locking tongue to said base;

a buckle cover defining a cavity for receiving said base and said latch mechanism, said cover including a front portion and a rear portion located opposite said front portion;

said cover and said base having cooperating means for retaining said cover and said base against relative movement, said cooperating means including a first set of tabs at said first end portion of said base, a second set of tabs at said second end portion of said base, first shoulder means on said cover at said rear portion for engaging said first set of tabs when said base is received in the cavity in said cover, and second shoulder means on said cover at said front portion for engaging said second set of tabs when said base is received in the cavity in said cover.

2. A seat belt buckle according to claim 1 wherein said first shoulder means partially defines a pair of slots located at said rear portion of said cover and said first set of tabs includes a pair of bending tabs which are bendable from an unbent position to a bent position into said pair of slots of said first shoulder means.

3. A seat belt buckle according to claim 2 wherein said second shoulder means partially defines a pair of slots located at said front portion of said cover and said second set of tabs includes a pair of fingers which are inserted into said pair of slots of said second shoulder means.

4. A seat belt buckle according to claim 3 wherein the portion of said first shoulder means engaged by said first set of tabs and the portion of said first shoulder means engaged by said second set of tabs face in opposite directions.

5. A seat belt buckle according to claim 2 wherein said pair of bending tabs have portions which deform the material of said first shoulder means as said bending tabs are bent, said deformed material of said first shoulder means being located in said pair of slots of said first shoulder means.

6. A seat belt buckle for receiving and locking a seat belt locking tongue, said seat belt buckle comprising:

a base including a retaining tab which is resiliently deflectable between a retracted position and an extended position;

a latch mechanism supported on said base for engaging and locking the seat belt locking tongue to said base;

a buckle cover defining a cavity for receiving said base and said latch mechanism;

said cover including deflector surface means for (i) resiliently deflecting said retaining tab from the extended position to the retracted position as said base is inserted into the cavity in said cover, and (ii) allowing said retaining tab to move resiliently from the retracted position to the extended position to engage with said cover to retain said base against movement relative to said cover and thereby block withdrawal of said base from the cavity in said cover when said base has been fully inserted into the cavity in said cover.

7. A seat belt buckle according to claim 6 wherein said retaining tab has a cam surface which is engageable with said deflector surface means to deflect said retaining tab from the extended position to the retracted position and a first blocking surface which is engageable with said cover when said base has been fully inserted into the cavity in said cover and said retaining tab has moved from the retracted position to the extended position to block withdrawal of said base from the cavity in said cover.

8. A seat belt buckle according to claim 7 wherein said base has an outer end portion with a second blocking surface which faces in the same general direction as said first blocking surface and is engageable with said cover when said base has been fully inserted into the cavity in said cover to further block withdrawal of said base from the cavity in said cover.

* * * * *